United States Patent [19]

Fucito

[11] Patent Number: 4,716,358

[45] Date of Patent: Dec. 29, 1987

[54] CONSTANT CURRENT CIRCUITS

[75] Inventor: Dermot T. Fucito, Norcross, Ga.

[73] Assignee: Northern Telecom Limited, Montreal, Canada

[21] Appl. No.: 929,715

[22] Filed: Nov. 12, 1986

[51] Int. Cl.[4] ..... G05F 3/28

[52] U.S. Cl. ..... 323/316; 323/349; 379/413

[58] Field of Search ..... 323/312, 315, 316, 349; 379/402, 413

[56] References Cited

U.S. PATENT DOCUMENTS 3,370,222 2/1968 Haagen-Smit et al. ..... 323/349 X 3,934,099 1/1976 Elder, Jr. ..... 379/402 X

FOREIGN PATENT DOCUMENTS 0001160 1/1986 Japan ..... 379/413

*Primary Examiner*—Patrick R. Salce

*Assistant Examiner*—Kristine Peckman

*Attorney, Agent, or Firm*—Schwartz, Jeffery, Schwaab, Mack, Blumenthal & Evans

[57] ABSTRACT

A constant current circuit includes a first constant current source including a transistor and a resistor, and a second source also including a resistor and a transistor which is controlled via a differential amplifier to produce a second constant current equal to the first. The differential amplifier has inputs connected to tapping points of similar potential dividers coupled between the current sources. The circuit is particularly applicable for supply d.c. sealing current via center-tapped transformer windings to the two balanced wire pairs of a four-wire transmission line.

10 Claims, 2 Drawing Figures

CONSTANT CURRENT CIRCUITS

Figure 1:
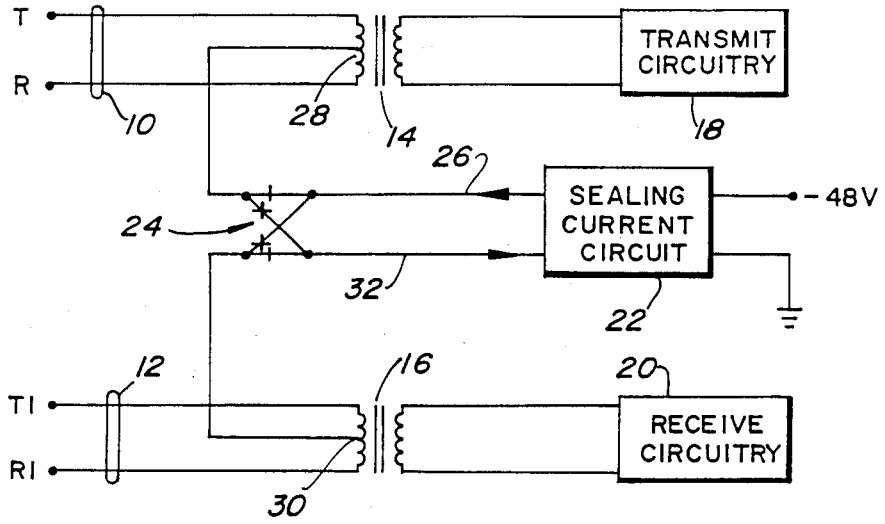
FIG. 1 (PRIOR ART)

This invention relates to constant current circuits, and is particularly concerned with such a circuit for providing a so-called sealing current on four-wire transmission lines.

It is known to provide a d.c. sealing current on a four-wire voice frequency transmission line, in order to maintain a low resistance at splices and other connection points by breaking down small accumulations of dirt and oxides, thereby reducing noise and other trouble conditions. To this end, a sealing current source is connected to simplex leads of transmit and receive transformers which are coupled to the four-wire line.

Transmission of voice and data signals on a four-wire line can be impaired by currents which are induced, in the two wires of each balanced pair of wires of the four-wire line, from external sources such as a.c. power lines and transformers. If such induced currents flow unequally in the two wires, for example due to the wires having different series or shunt impedances and hence being imperfectly balanced, then a metallic current exists which can disturb transmission. Such metallic currents can be minimized by making the impedance of the sealing current source large relative to the imbalance in impedance of the two wires. Hence a constant current circuit, or high impedance current source, is required to constitute the sealing current source.

Furthermore, as the sealing current is a loop circuit, flowing in opposite directions on the two balanced pairs of wires of the four-wire line, it is desirable for the sealing current source to supply to and sink from the respective wire pairs precisely the same sealing current.

An object of this invention, therefore, is to provide an improved constant current circuit, which is particularly suitable for providing a sealing current on a four-wire transmission line.

According to this invention there is provided a constant current circuit comprising: first means for passing a constant current, said first means having first and second terminals; second means for passing a current, the second means having first and second terminals and including control means for controlling the current passed by the second means; a first potential divider connected between the first terminals of the first and second means and having a tapping point; a second potential divider connected between the second terminals of the first and second means and having a tapping point; and amplifier means responsive to potential difference between the tapping points of the first and second potential dividers for controlling the control means, whereby the current passed by the second means has a predetermined relationship to the constant current passed by the first means.

Preferably the first and second potential dividers have equal potential division ratios to their tapping points whereby the current passed by the second means is equal to the constant current passed by the first means.

In a preferred embodiment of the invention, the second means comprises a transistor constituting said control means, the transistor having a base coupled to an output of the amplifier means, a collector coupled to the first terminal of the second means, and an emitter; and a resistor coupled between the emitter and the second terminal of the second means. Conveniently, the first means comprises a transistor having a base coupled to a reference voltage, a collector coupled to the first terminal of the first means, and an emitter; and a resistor coupled between the emitter and the second terminal of the first means.

The circuit preferably includes means for smoothing signals at at least one of the tapping points.

The invention also provides an arrangement for passing d.c. sealing current on two balanced wire pairs of a four-wire line, comprising a constant current circuit as recited above; a first transformer having a center-tapped winding coupled to one of the two balanced wire pairs, the center tap being coupled to the first terminal of the first means; and a second transformer having a center-tapped winding coupled to the other of the two balanced wire pairs, the center tap being coupled to the first terminal of the second means.

Figure 2:
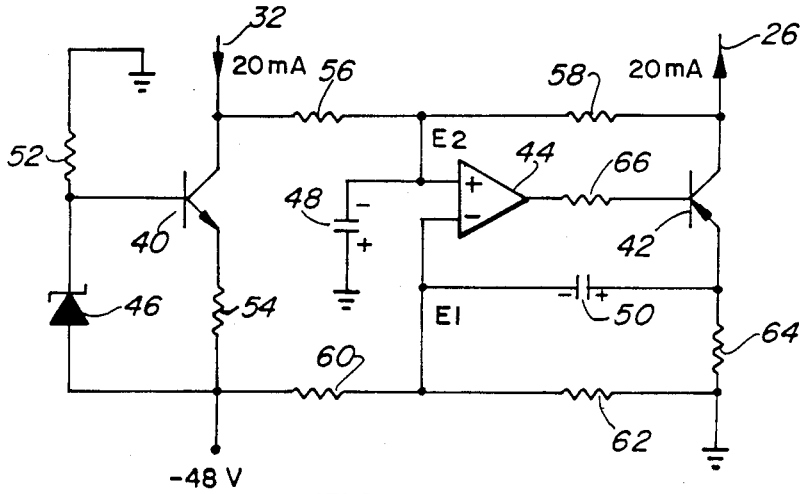

The invention will be further understood from the following description with reference to the accompanying drawings, in which:

FIG. 1 schematically illustrates a known arrangement for providing sealing current on a four-wire transmission line; and FIG. 2 schematically illustrates a constant current circuit in accordance with an embodiment of this invention for use in an arrangement as illustrated in FIG. 1.

Referring to FIG. 1, there is illustrated a four-wire transmission line comprising two balanced wire pairs 10, 12 for transmit and receive directions which are coupled via transformers 14, 16 to transmit circuitry 18 and receive circuitry 20 of a voice frequency (VF) channel unit in a VF carrier transmission system. As this invention is not concerned with the specific form of the transmit and receive circuitry 18 and 20, this is not described further here.

In order to maintain a low resistance at splices and other connection points on the line 10, 12, a d.c. sealing current is supplied from a sealing current circuit 22, via a reversing switch 24 by means of which the current direction can be reversed, to center taps on the windings of the transformers 14 and 16 which are connected to the line 10, 12. Thus for example a d.c. sealing current may be conducted from the circuit 22 via a wire 26, the switch 24 and a center tap 28 of the transformer 14 to both wires T, R of the balanced wire pair 10, this current returning via both wires TI, RI of the balanced wire pair 12, a center tap 30 of the transformer 16, the switch 24, and a wire 32 to the circuit 22.

As already described, it is desirable for the sealing current circuit 22 to have a high impedance, and hence to act as both a constant current source and a constant current sink for the two directions of the sealing current. This invention, an embodiment of which is described below with reference to FIG. 2, is concerned with the provision of such a constant current circuit.

The circuit illustrated in FIG. 2 comprises transistors 40, 42; a differential amplifier 44; a zener diode 46; capacitors 48 and 50; and resistors 52, 54, 56, 58, 60, 62, 64 and 66.

The elements 40, 46, 52, and 54 are arranged in conventional manner to pass, or sink, a constant current of 20mA from the wire 32, this current value being determined by the zener voltage of the zener diode 46 and the resistance of the resistor 54. The transistor 42 and resistor 64, which has the same resistance as the resistor 54, serve to pass, or supply, an equal constant current of 20mA to the wire 26. The capacitors 48 and 50 serve to filter any alternating voltages which may be present from outside sources, for example appearing on the wires 26 and 32 and hence at the collectors of the transistors 40 and 42.

The remainder of the circuit in FIG. 2 serves to control the transistor 42 so that it acts as a constant current source as described above, to pass the same current as the transistor 40. To this end, the resistors 56 and 58 are connected as a potential divider between the wires 32 and 26, and the resistors 60 and 62 are connected as a similar potential divider between the resistors 54 and 64, on the sides thereof which are connected to supply voltages of −48 volts and ground respectively. The differential amplifier 44 has its inputs connected to the tapping points of these potential dividers, and its output connected via the resistor 66, which acts as a current limiter, to the control or base electrode of the transistor 42.

In operation, the circuit of FIG. 2 serves to maintain voltages EI and E2 at the differential amplifier inputs, and hence at the tapping points of the potential dividers, equal. The voltage E1 is fixed, for example at −24 volts (half the supply voltage) if the resistors 60 and 62 have equal resistances, whereby the voltage E2 is maintained at the same value. Any departure of the voltage E2 from this value is amplified by the amplifier 44 so that a correction signal is supplied to the transistor 42 to equalize the voltages E1 and E2.

Considered alternatively, the circuit of FIG. 2 maintains the voltage dropped across the series combination of the transistor 42 and the resistor 64 equal to the voltage dropped across the series combination of the transistor 40 and the resistor 54, whereby precisely the same current is passed to the wire 26 as is received from the wire 32.

Numerous other modifications, variations, and adaptations may be made to the embodiment described above without departing from the scope of the invention as defined in the claims.

What is claimed is:

1. A constant current circuit comprising:

first means for passing a constant current, said first means having first and second terminals;

second means for passing a current, the second means having first and second terminals and including control means for controlling the current passed by the second means;

a first potential divider connected between the first terminals of the first and second means and having a tapping point;

a second potential divider connected between the second terminals of the first and second means and having a tapping point; and amplifier means responsive to potential difference between the tapping points of the first and second potential dividers for controlling the control means, whereby the current passed by the second means has a predetermined relationship to the constant current passed by the first means.

2. A constant current circuit as claimed in claim 1 wherein the first and second potential dividers have equal potential division ratios to their tapping points whereby the current passed by the second means is equal to the constant current passed by the first means.

3. A constant current circuit as claimed in claim 2 wherein the second means comprises a transistor constituting said control means, the transistor having a base coupled to an output of the amplifier means, a collector coupled to the first terminal of the second means, and an emitter; and a resistor coupled between the emitter and the second terminal of the second means.

4. A constant current circuit as claimed in claim 3 wherein the first means comprises a transistor having a base coupled to a reference voltage, a collector coupled to the first terminal of the first means, and an emitter; and a resistor coupled between the emitter and the second terminal of the first means.

5. A constant current circuit as claimed in claim 1 and including means for smoothing signals at at least one of the tapping points.

6. A constant current circuit as claimed in claim 2 and including means for smoothing signals at at least one of the tapping points.

7. An arrangement for passing d.c. sealing current on two balanced wire pairs of a four-wire line, comprising:

a first transformer having a center-tapped winding coupled to one of the two balanced wire pairs;

a second transformer having a center-tapped winding coupled to the other of the two balanced wire pairs; and a constant current circuit comprising:

first means for passing a constant current, said first means having first and second terminals, the first terminal of the first means being coupled to the center tap of the first transformer;

second means for passing a current, the second means having first and second terminals and including control means for controlling the current passed by the second means, the first terminal of the second means being coupled to the center tap of the second transformer;

a first potential divider connected between the first terminals of the first and second means and having a tapping point;

a second potential divider connected between the second terminals of the first and second means and having a tapping point; and amplifier means responsive to potential difference between the tapping points of the first and second potential dividers for controlling the control means;

the first and second potential dividers having equal potential division ratios to their tapping points whereby the current passed by the second means is equal to the constant current passed by the first means.

8. An arrangement as claimed in claim 7 wherein the second means comprises a transistor constituting said control means, the transistor having a base coupled to an output of the amplifier means, a collector coupled to the first terminal of the second means, and an emitter; and a resistor coupled between the emitter and the second terminal of the second means.

9. An arrangement as claimed in claim 8 wherein the first means comprises a transistor having a base coupled to a reference voltage, a collector coupled to the first terminal of the first means, and an emitter; and a resistor coupled between the emitter and the second terminal of the first means.

10. An arrangement as claimed in claim 7 and including means for smoothing signals at at least one of the tapping points.

* * * * *